United States Patent [19]

Kawakubo et al.

[11] Patent Number: 5,052,633

[45] Date of Patent: Oct. 1, 1991

[54] BOBBIN WINDER TENSION APPLICATION DEVICE

[75] Inventors: Kiyoshi Kawakubo; Yoshimi Koguchi, both of Tochigi, Japan

[73] Assignee: SSMC Inc., Edison, N.J.

[21] Appl. No.: 396,155

[22] Filed: Aug. 21, 1989

[30] Foreign Application Priority Data

Sep. 9, 1988 [JP] Japan ..... 63-117888

[51] Int. Cl.[5] ..... B65H 59/22

[52] U.S. Cl. ..... 242/150 R; 242/20; 242/153

[58] Field of Search ..... 242/150 R, 150 M, 147 R, 242/149, 153, 154, 20, 21, 22, 23, 24, 129.8

[56] References Cited

U.S. PATENT DOCUMENTS

| | | | |
|---|---|---|---|
| 500,778 | 7/1893 | Sampson | 242/154 |
| 768,926 | 8/1904 | Bates | 242/153 |
| 1,997,709 | 4/1935 | Williams | 242/154 |
| 2,232,262 | 2/1941 | Parkinson | 242/150 R |
| 2,532,467 | 12/1950 | Pierre | 242/150 R |
| 2,584,320 | 2/1952 | Armenti | 242/20 X |
| 3,614,006 | 10/1971 | Pararra | 242/20 |
| 4,211,373 | 7/1980 | Papajewski et al. | 242/20 |

*Primary Examiner*—Stanley N. Gilreath
*Attorney, Agent, or Firm*—Theodore Jay

[57] ABSTRACT

A tension shaft projects upwardly from a frame. A tension adjusting nut is adjustably screwed into an upper portion of the tension shaft. A pair of tension disks are rotatably supported by the tension shaft. A tension spring is supported by the tension shaft between one of the tension disks and the tension adjusting nut for urging one of the tension disks toward the other tension disk. A thread guide member fixed to the tension shaft has a plurality of thread holes. The device is characterized in that a bobbin thread threaded into the plurality of thread holes is elastically clamped between the pair of tension disks.

1 Claim, 3 Drawing Sheets

BOBBIN WINDER TENSION APPLICATION DEVICE

BACKGROUND OF THE INVENTION

1. Field of the Invention

The present invention relates to a bobbin winder tension application device for applying a tension to a bobbin thread drawn from a bobbin winder tube of a spool holder base when the bobbin thread is wound on a bobbin. A uniform and appropriate tension can be applied to the bobbin thread to be wound on the bobbin.

2. Description of Prior Art

A prior art bobbin winder tension application device of this type will be described with reference to FIGS. 1 and 6.

A spool holder base 2 attached to a table 3 of a sewing machine (hereinafter referred to as table) has a bobbin winder shaft 4 securely mounted thereon. A bobbin thread 8 wound on a bobbin winder tube 11 is inserted into and engaged with the bobbin winder shaft 4 and is guided via a thread hole 2*b* of the spool holder base 2. The bobbin thread 8 is unwound from the tube by bobbin winder tension application device 100 provided at a frame 1 of the sewing machine. This device then winds the thread on a bobbin 6 attached to the frame of the sewing machine. The bobbin thread 8 passes through the thread hole 2*b* of the spool holder base 2 then passes through a single thread hole 102 of a thread guide member 101 of the bobbin winder tension application device 100, then is elastically clamped between a pair of tension disks 103, 103, whereby a predetermined tension is applied to the bobbin thread 8, and finally is wound on the bobbin 6. A tension spring 105 is disposed between a tension shaft 104 and a tension adjusting nut 106 as illustrated in FIG. 6.

However, since the prior art bobbin winder tension application device 100 causes the bobbin thread 8 to pass through the single thread hole 102 of the thread guide member 101, then is clamped by the pair of tension disks 103, 103 whereby the predetermined tension is applied to the bobbin thread 8, the bobbin thread 8 is twisted in a spiral and when inserted into the pair of tension disks can slip off the tension disks 103, 103. This action occurs because the bobbin thread 8 as it is unwound from the thread bobbin winder tube 11 is drawn upwardly, namely, in the axial direction of the main shaft of the spool holder base.

Because of the twisting action the bobbin thread 8 is liable to slip off between the pair of tension disks 103, 103 which creates difficulties in winding the bobbin thread and lowers the working efficiency.

SUMMARY OF THE INVENTION

It is a first object of the present invention to provide a bobbin winder tension application device capable of preventing a bobbin thread from slipping off between a pair of tension disks.

A second object of the present invention is to provide a bobbin winder tension application device employing a guide member having a plurality of holes which is adapted to untwisting the twist generated on the bobbin thread.

To achieve the above objects of the present invention, the bobbin winder tension application device of the present invention comprises a tension shaft projected upwardly from a frame of a sewing machine. A tension nut is adjustably screwed into an upper portion of the tension shaft. A pair of tension disks are rotatably supported by the tension shaft. A tension spring is supported by the tension shaft between one of the tension disks and the tension nut for urging one of the tension disks toward the other tension disk. A thread guide member is secured to the tension shaft. This thread guide member has a plurality of thread holes, and is characterized in that a thread threaded into the plurality of thread holes is elastically clamped between the pair of tension disks.

The above and other objects, features and advantages of the present invention will become more apparent from the following description taken in conjunction with the accompanying drawings.

DESCRIPTION OF PREFERRED EMBODIMENT OF THE INVENTION

Figure 1:
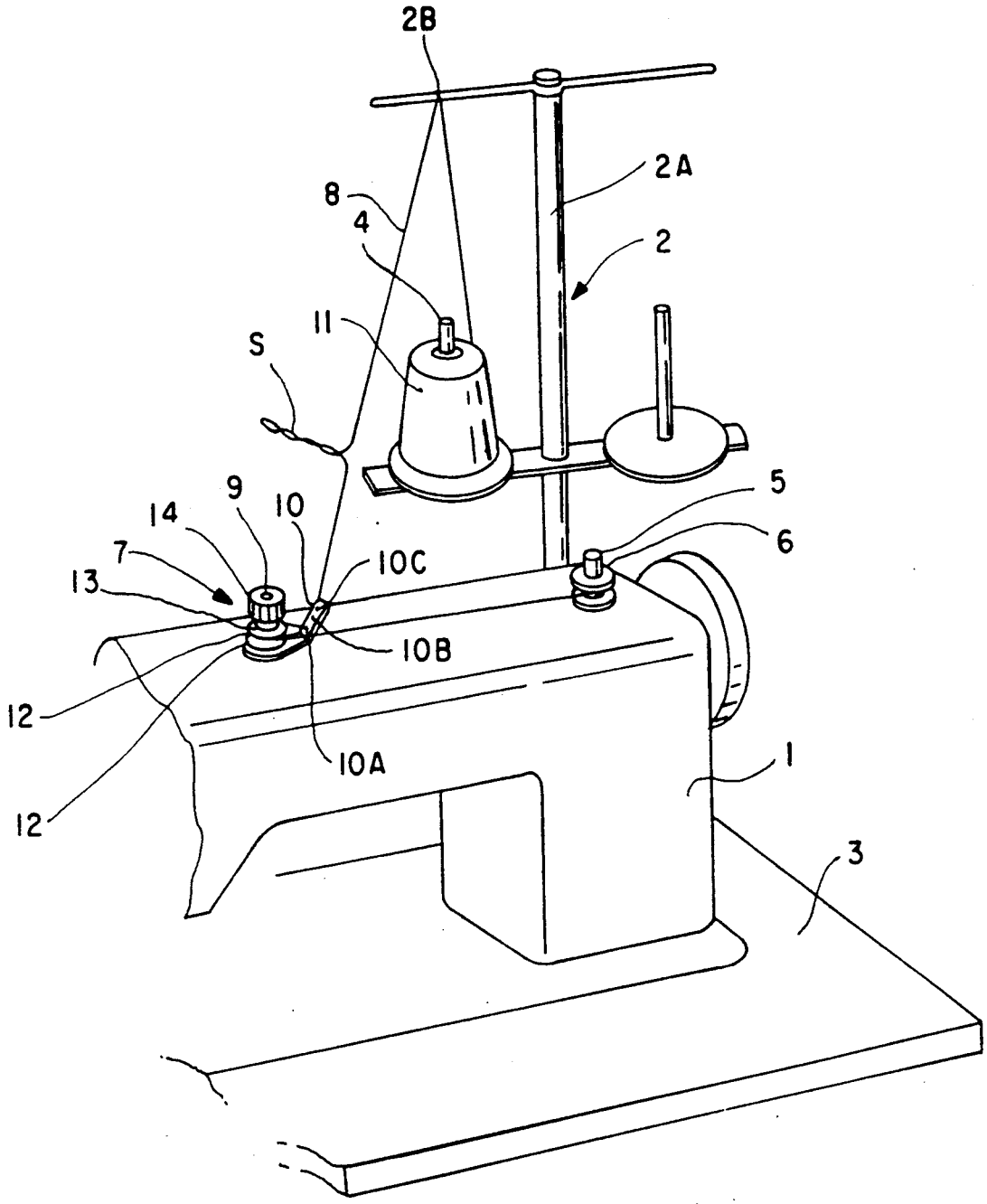
FIG. 1 is a perspective view of an essential portion of a sewing machine as employed in the prior art.
Figure 2:
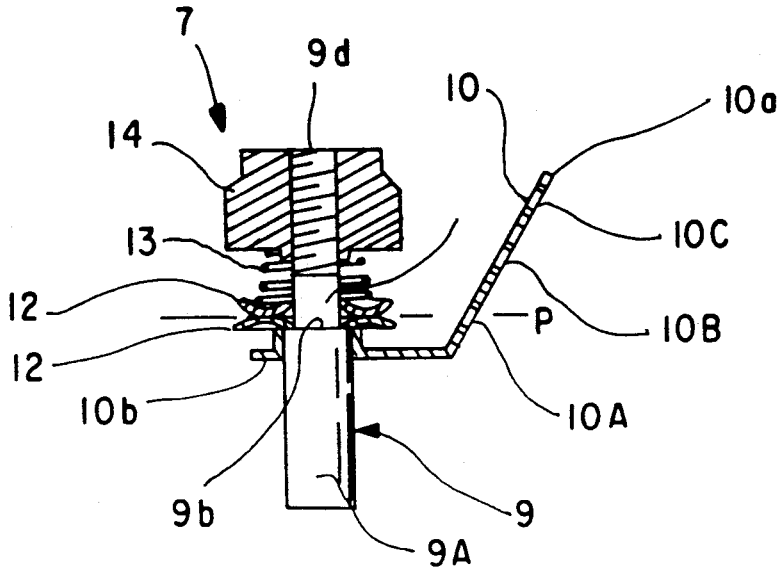
FIG. 2 is an enlarged cross sectional view of a bobbin winder tension application device in accordance with this invention.
Figure 3:
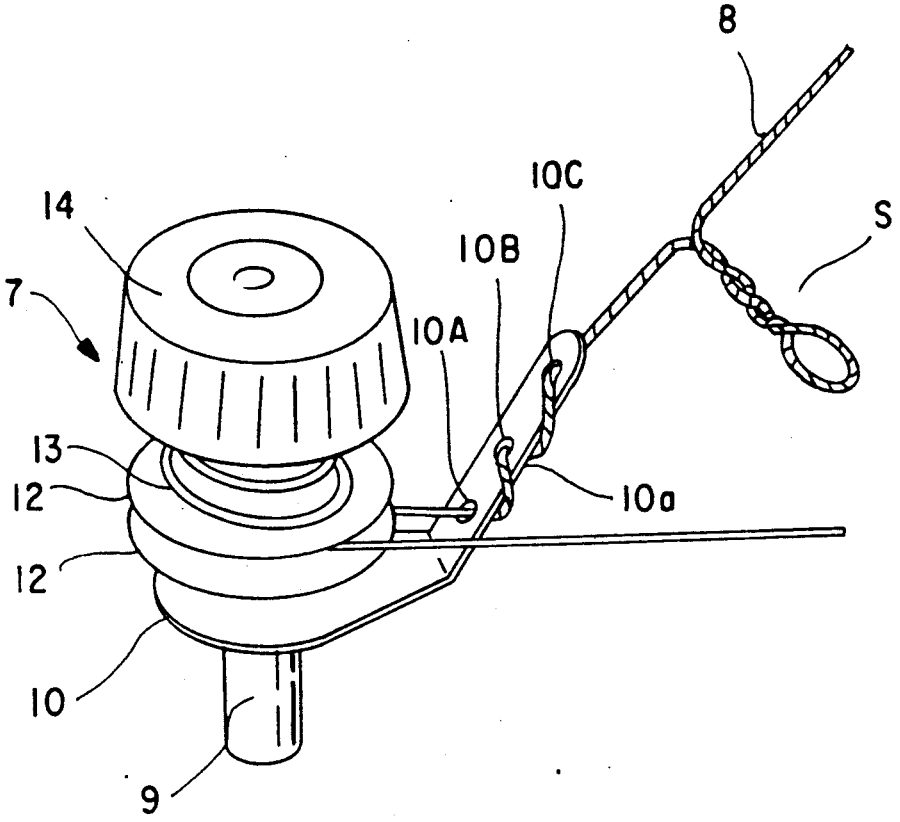
FIG. 3 is an additionally enlarged view of this bobbin winder tension application device.
Figure 4:
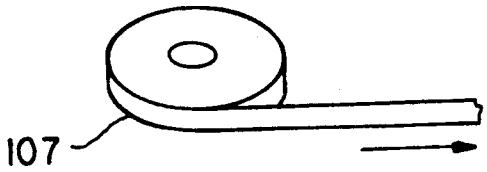
FIG. 4 illustrates the action of eliminating twists.
Figure 5:
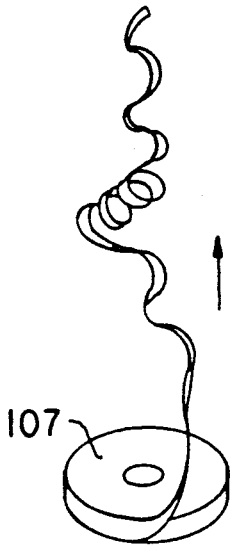
FIG. 5 illustrates the action of creating twists.
Figure 6:
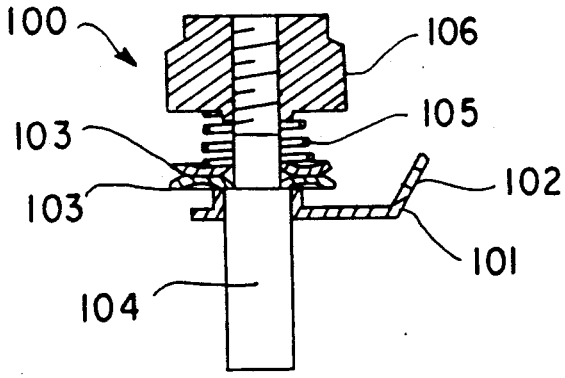
PRIOR ART Fig. 6
FIG. 6 is a cross sectional view of a prior art bobbin winder tension application device.

A bobbin winder tension application device according to a preferred embodiment of the present invention will be described with reference to FIGS. 1 to 3.

The main shaft 2*a* of a spool holder base 2 is attached to a table 3 of the sewing machine behind a frame 1 of the sewing machine. A bobbin winder shaft 5 is projected from an upper surface of the frame 1 and is rotated by a drive means positioned within the frame 1. A bobbin 6 is nonrotatably and detachably secured to the bobbin winder shaft 5. A bobbin winder tension application device 7 is positioned on the upper surface of the frame 1 opposite the bobbin winder shaft 5. The bobbin winder tension application device 7 includes a tension shaft 9 projected upwardly from the frame 1; a tension shaft; a pair of tension disks 12, 12 rotatably supported by the tension shaft 9; a tension spring 13 supported by the tension shaft 9 between one of the tension disks 12, 12 and the tension adjusting nut 14 for urging one of the tension disks 12 toward the other tension disk 12; and a thread guide member 10 fixed to the tension shaft. The thread guide member 10 has a plurality of thread holes 10A, 10B, 10C, and is characterized in that a bobbin thread threaded into the plurality of thread holes 10A, 10B, 10C is elastically clamped between the pair of tension disks 12, 12.

The tension shaft 9 comprises a large diameter portion 9*a* fixed to the frame 1 and a small diameter portion 9*c* which is extended from the large diameter portion 9*a* via a stepped surface 9*b*. The small diameter portion 9*c* has at one end thereof a screw portion 9*d*. The pair of tension disks 12, 12 are provided oppositely on the small diameter portion 9*c* of the tension shaft 9 so as to be rotatably inserted thereinto and supported by the stepped surface 9*b*. The movement thereof is restricted by the stepped surface 9*b*. The tension spring 13 is placed on one of the pair of tension disks 12, 12. The tension adjusting nut 14 is screwed into the screw portion 9*d* of the tension shaft 9. Hence, one of the pair of tension disks 12, 12 is urged elastically by the tension spring 13 toward the other tension disk 12. Accordingly, contact pressure between the pair of tension disks can be varied by tightening or loosening the tension adjustment nut 14.

The large diameter portion 9*a* of the tension shaft 9 has a cylindrical base 10*b* of the plate like thread guide member 10 secured thereto by pressing means. The thread guide member 10 has a bent piece 10*a* inclined upwardly and has a plurality of thread holes 10A, 10B, 10C directed from the base of the bent piece 10 to the distal end of the bent piece 10*a*. The thread hole 10A positioned at the base of the bent piece 10*a*, and, closest to the frame 1 is positioned substantially along the extension of the contact surface P of the pair of tension disks 12, 12 as shown in FIG. 2.

An end of the bobbin thread 8 drawn from the bobbin winder tube 11 rotatably supported by the bobbin winder shaft 4 of the spool holder base 2 is passed through the thread hole 2*b* of the spool holder base 2 and is turned in its direction. Thereafter, the end of the bobbin thread 8 is threaded into the upper end thread hole 10C from one side of the bent portion 10*a*, namely, the reverse surface side relative to the tension shaft 9, and wound one turn on the half portion of the bent piece 10*a*. This end is then threaded into the thread hole 10B from the same reverse surface side, then further is wound one turn on the half portion of the bent piece 10*a*, and finally is threaded into the thread hole 10C from the same reverse surface side. The bobbin thread 8 drawn from the other surface side of the bent piece 10*a* passes between the pair of tension disks 12, 12 and is wound on the small diameter portion 9*c* of the tension shaft 9, then turned through 360 degrees to reverse the direction of feed. Thereafter, the bobbin thread 8 is wound on the bobbin 6. Thus, the bobbin thread 8 is elastically clamped by the pair of the tension disks 12, 12 so that a predetermined tension is applied to the bobbin thread 8 by friction. At this state, if the bobbin winder shaft 5 is rotated together with the bobbin 6, a spiral twist or kink S enlarged into the size of a fist will be formed on the bobbin thread 8 delivered from the bobbin winder tube 11. The twist or kink S progressing together with the bobbin thread 8 passes sequentially through the plurality of thread holes 10C, 10B, 10A of the thread guide member 10, and repeatedly drawn during spiral progression along the half portion of the bent piece 10 so that the twist or kink S is gradually untwisted or unkinked. Furthermore, the bobbin thread 8 is introduced between the one pair of tension disks 12, 12 from the lowermost thread hole 10A positioned substantially on the extension extended from the contact surface P of the pair of tension disks 12, 12.

As a result, the bobbin thread 8 is smoothly inserted between the one pair of tension disks 12, 12 and is prevented from slipping off between the tension disks 12, 12.

The sizes of the plurality of thread holes 10A, 10B, 10C of the thread guide member 10 can be varied, for example, so as the thread hole 10C remote from the frame 1 is a large diameter hole, and the thread hole closer to the frame 1 has a smaller diameter, and the thread hole 10A closest to the frame 1 has the smallest diameter. With such an arrangement of the size of the thread holes, the bobbin thread 8 having the twist S is drawn every time it passes each thread hole 10C, 10B, 10A so that the twist or kink will be small or eliminated and the tension applied to the bobbin thread 8 which is to be drawn and wound on the bobbin 6 will not be excessive.

As a result, the bobbin thread can be smoothly inserted between the pair of tension disks thereby preventing the thread from being slipped off therebetween. Among a plurality of thread holes of the guide members, the thread hole closest to the frame of the sewing machine is caused to be positioned substantially along the extension of contact surface of the pair of tension disks whereby the thread can be moved smoothly between the tension disks.

With the arrangement of the bobbin winder tension application device according to the present invention, namely, provision of a plurality of thread holes on the thread guide member causes the twist S to be gradually untwisted, whereby the bobbin thread is prevented from being slipped off between the tension disks and the efficiency of the thread winding operation can be improved remarkably.

Although the invention has been described in its preferred form with a certain degree of particularity, it is to be understood that many variations and changes are possible in the invention without departing from the scope thereof.

What is claimed is:

1. A bobbin winder tension application device comprising:

a sewing machine frame;

a tension shaft projected upwardly from said frame;

a tension adjusting nut adjustably screwed onto an upper portion of the tension shaft;

a pair of like horizontal disks vertically separated and rotatably supported by the tension shaft, one of said disks being disposed above the other, said disks flaring out from each other at their adjacent external peripheries;

a tension spring supported by the tension shaft and disposed between said one disk and the tension nut for urging said one disk toward the other;

a thread guide member having a flat horizontal section with an opening through which the tension shaft extends, the horizontal section being secured to said shaft and disposed adjacent and below the other disk, said horizontal section terminating in a flat extension spaced from the disks and extending upwardly and outwardly therefrom, said extension having a plurality of spaced holes disposed therealong whereby the separation between each hole and shaft differs for each hole, said holes being disposed so that the separation is minimum for the lowest hole and increases for each additional hole, the highest hole exhibiting the largest separation, the lowest hole being horizontally aligned with the space between the flared out peripheries of said disks; and means to feed a thread inclinedly downwardly along said extension and through said holes, the thread exiting from the lowest hole along a horizontal path and aligned with the space, the thread being disposed and being elastically clamped between said disks.

* * * * *